United States Patent [19]

Mammino

[11] 4,265,995

[45] May 5, 1981

[54] CARRIER CORE SURFACE TREATMENT

[75] Inventor: Joseph Mammino, Penfield, N.Y.

[73] Assignee: Xerox Corporation, Stamford, Conn.

[21] Appl. No.: 87,119

[22] Filed: Oct. 22, 1979

[51] Int. Cl.[3] ..... G03G 9/00

[52] U.S. Cl. ..... 430/107; 430/108; 430/109; 430/110; 430/111; 430/137

[58] Field of Search ..... 430/105, 106, 107, 108, 430/109, 110, 111, 137

[56] References Cited

U.S. PATENT DOCUMENTS

| | | | |
|---|---|---|---|
| 3,778,262 | 12/1973 | Queener et al. | 430/107 |
| 3,922,381 | 11/1975 | Datta | 430/107 |
| 4,139,483 | 2/1979 | Williams | 430/110 |

FOREIGN PATENT DOCUMENTS

| | | | |
|---|---|---|---|
| 2264311 | 3/1975 | France | 430/110 |

*Primary Examiner*—Mary F. Downey

[57] ABSTRACT

An electrostatographic developer mixture comprising finely-divided, positively triboelectrically charging toner particles electrostatically clinging to negatively triboelectrically charging carrier particles. The carrier particles comprise a core particle treated with from between about 0.001 percent and about 1.0 percent by weight of at least one surface active additive selected from highly fluorinated materials having an ionic group selected from a cationic, anionic, nonionic, and amphoteric group. The developer mixture is especially useful for the development of negatively charged electrostatic latent images.

10 Claims, No Drawings

CARRIER CORE SURFACE TREATMENT

This invention is generally concerned with electrostatographic imaging systems and, more specifically, to improved imaging materials, their manufacture, and use.

It is well known to form and develop images on the surface of photoconductive materials by electrostatic methods such as described, for example, in U.S. Pat. Nos. 2,297,691; 2,277,013; 2,551,582; 3,220,324; and 3,220,833. In summary, these processes as described in the aforementioned patents involve the formation of an electrostatic latent charged image on an insulating electrophotographic element and rendering the latent image visible by a development step whereby the charged surface of the photoconductive element is brought into contact with a developer mixture. As described in U.S. Pat. No. 2,297,691, for example, the resulting electrostatic latent image is developed by depositing thereon a finely-divided electroscopic material referred to in the art as toner, the toner being generally attracted to the areas of the layer which retain a charge thus forming a toner image corresponding to the electrostatic latent image. Subsequently, the toner image can be transferred to a support surface such as paper and this transferred image can be permanently affixed to the support surface using a variety of techniques including pressure fixing, heat fixing, solvent fixing, and the like.

Many methods are known for applying the electroscopic particles to the latent image including cascade development, touchdown and magnetic brush as illustrated in U.S. Pat. Nos. 2,618,552; 2,895,847 and 3,245,823. One of the most widely used methods is cascade development wherein the developer material comprising relatively large carrier particles having finely-divided toner particles electrostatically clinging to the surface of the carrier particles is conveyed to and rolled or cascaded across the electrostatic latent image-bearing surface. Magnetic brush development is also known and involves the use of a developer material comprising toner and magnetic carrier particles which are carried by a magnet so that the magnetic field produced by the magnet causes alignment of the magnetic carriers in a brush-like configuration. Subsequently, this brush is brought into contact with the electrostatic latent image-bearing surface causing the toner particles to be attracted from the brush to the electrostatic latent image by electrostatic attraction, as more specifically disclosed in U.S. Pat. No. 2,874,063.

Carrier materials used in the development of electrostatic latent images are described in many patents including, for example, U.S. Pat. No. 3,590,000. The type of carrier material to be used depends on many factors such as the type of development used, the quality of the development desired, the type of photoconductive material employed and the like. Generally, however, the materials used as carrier surfaces or carrier particles or the coating thereon should have a triboelectric value commensurate with the triboelectric value of the toner in order to generate electrostatic adhesion of the toner to the carrier. Carriers should be selected that are not brittle so as to cause flaking of the surface or particle break-up under the forces exerted on the carrier during recycle as such causes undesirable effects and could, for example, be transferred to the copy surface thereby reducing the quality of the final image.

There have been recent efforts to develop carriers and particularly coatings for carrier particles in order to obtain better development quality and also to obtain a material that can be recycled and does not cause any adverse effects to the photoconductor. Some of the coatings commercially utilized deteriorate rapidly especially when employed in a continuous process whereby the entire coating may separate from the carrier core in the form of chips or flakes as a result of poorly adhering coated material and fail upon impact and abrasive contact with machine parts and other carrier particles. Such carrier particles generally cannot be reclaimed or reused and usually provide poor print quality results. Further, the triboelectric values of some carrier coatings have been found to fluctuate when changes in relative humidity occur and thus these carriers are not desirable for use in electrostatographic systems as they can adversely affect the quality of the developed image.

Further, when attempting to provide carrier materials having conductive properties such as by partially coating conductive carrier cores with an electrically insulating resin, the amount of coating material applied must be carefully controlled so that enough uncoated areas remain on the carrier cores to provide conductive paths between the carrier material and the photoreceptor. Such partially coated carrier materials are extremely difficult to reproducibly control and manufacture, they produce bimodal triboelectric charging sites, they have narrow toner concentration latitudes quickly yielding insulating developers, and provide short developer life. Further still, in particular electrostatographic reproduction systems, in order to develop a latent image comprised of negative electrostatic charges, such as when employing an organic electrophotosensitive material as the photoreceptor, an electrostatic carrier and toner powder combination must be selected in which the toner is triboelectrically charged positively relative to the granular carrier. Thus, there is a continuing need for a better electrostatographic carrier material and an improved method for its preparation.

SUMMARY OF THE INVENTION

It is, therefore, an object of this invention to provide improved carrier materials which overcome the above-noted deficiencies of conventional carrier materials.

It is another object of this invention to provide carrier beads having conductive characteristics and greatly increased useful life.

It is another object of this invention to provide a method for altering the triboelectric charging values of a carrier material without markedly changing the physical and chemical properties of the original carrier material.

It is a further object of this invention to provide electrostatographic carrier materials having conductive properties.

A further object of this invention is to provide improved developer materials, especially improved carrier materials, which may be used in electrostatographic development environments where the photoreceptor is negatively charged.

It is another object of this invention to provide carrier beads having triboelectric proerties superior to known carrier beads.

The foregoing objects and others are accomplished, generally speaking, by providing treated carrier particles having electrically conductive properties and negative triboelectric charging potentials. More specifically, the carrier particles of this invention comprise a core particle having an average diameter of from between about 30 microns and about 1,000 microns treated with from between about 0.001 percent and about 1.0 percent by weight, based on the weight of the carrier particles, of at least one surface active additive. The surface active additives of this invention are capable of providing a desired polarity and magnitude of triboelectric charging potential to the carrier materials of this invention. In addition to providing the aforementioned triboelectric properties to the carrier compositions of this invention, the surface active additive also provides carrier compositions which have anti-stick or low surface energy properties thereby minimizing toner particle filming thereon such as by impaction.

In accordance with this invention, typical toner compositions which previously entered into a triboelectric charging relationship with uncoated or partially coated metallic carrier cores to yield negatively charged toner particles are now found to yield positively triboelectrically charged toner particles when mixed with the treated carrier particles of this invention. The resulting developer mixtures are especially useful for the development of negatively charged photoreceptors, such as those made from organic photoconductive materials. The negatively charged electrostatic latent image on such photoreceptors thus attacts the positively charged toner particles to develop the image.

In the preparation of the treated carrier particles of this invention, carrier cores are generally contacted with the surface active additives as to cause the surface active additives to react with, absorb onto, or otherwise attach to the surface of the carrier cores. The surface active additives may be utilized by themselves or in combination with other carrier core coating materials in the treatment of the carrier particles. In one embodiment, treated carrier cores may be provided by contacting the carrier cores with a surface active additive which has been dissolved in a solvent, separating the carrier cores from the treating solution, and washing the treated carrier cores with clear solvent. In a preferred embodiment, the surface active additive is dissolved in a suitable solvent such as methyl alcohol, the carrier cores are contacted with the treating solution, and the solvent is evaporated leaving the surface active additive coated on the carrier cores. In addition, the surface active additive may be dispersed in a carrier coating resinous material solution and applied to uncoated or coated carrier particles. Where a carrier coating resinous material is employed, it is preferred that the resin component be melted or dissolved followed by the addition thereto of the surface active additive, and the components thoroughly mixed to yield a uniform mixture of the additive in the resin component. The resulting mixed composition may then be spray-dried onto carrier cores or blended with carrier cores followed by removal of any solvent employed in application of the coating composition to the carrier cores. Due to its low surface energy properties, the surface active additive generally resides at or near the surface of the carrier particles.

In addition, it has been found that when a resinous coating material is employed over metallic carrier cores the resultant carrier particles are provided with satisfactory triboelectric charging properties, however, their electrical conductivity characteristics are weak due to the insulating nature of the resinous coating material. Attempts to improve the conductivity characteristics of the coated carrier particles by the addition of conductive materials such as carbon black to the coating composition have resulted in increased carrier particle conductivity characteristics, however, the triboelectric charging properties of the carrier particles have been found to suffer in that they are substantially weaker. Pursuant to this invention, the incorporation of the present surface active additives to carrier particles having a coating of resinous material containing a conductive material has been found to provide carrier particles having satisfactory electrically conductive characteristics and satisfactory triboelectric charging properties. The foregoing carrier properties are especially important where it is desired to employ conductive carrier particles to provide a developer mixture having a breakdown voltage of between about 100 volts and about 500 volts in an electrostatographic copying or duplicating device. The treated carrier particles of this invention will provide such conductivity characteristics while also having satisfactory triboelectric charging properties when mixed with finely-divided toner particles.

The surface active additives of this invention are selected from highly fluorinated materials. These highly fluorinated materials are fluorochemical surface active agents, also known as fluorochemical surfactants and comprise ionic solubilizing groups linked to highly branched perfluoro groups. Typical compositions include ammonium perfluoroalkyl sulfonates, potassium perfluoroalkyl sulfonates, potassium fluorinated alkyl carboxylates, and ammonium perfluoroalkyl carboxylates. These compositions are commercially available under the tradename Monflor available from ICI America, Zonyl from E. I. duPont, and Fluorad from 3M. These materials contain anioni, cationic, or nonionic groups providing a wide range of surface active behavior. They are extremely active and in concentrations of as low as 0.1% are available to reduce the surface tension of polymers to values as low as 20 dynes/cm. These surface active additives, by virtue of their low surface energy or the extent of their compatibility or association with polymer matrix, will preferentially reside close to the polymer-air interface, so long as thermodynamic equilibrium is allowed to occur within the processing time period. The concentration centration required for modification of polymer surface properties such as triboelectric charging is extremely low so that other bulk properties such as impaction resistance of the carrier composition are not adversely affected.

As earlier indicated, the treated carrier particles of this invention may contain from about 0.001 percent to about 1.0 percent by weight based on the weight of the treated carrier particles, of the surface active additive. Preferably, the carrier particles of this invention contain from about 0.01 percent to about 0.5 percent by weight of the surface active additive because the desired polarity and optimum results are obtained. Optimum results are obtained when the carrier particles of this invention contain from about 0.1 percent to about 0.3 percent by weight, based on the weight of the carrier particles, of the surface active additives of this invention. Further, the surface active additives of this invention provide reduced toner impaction onto carrier particles thereby extending carrier particle life.

Any suitable solid material having an average particle diameter of between about 30 microns and about 1,000 microns may be employed as the carrier core in this invention. Typical satisfactory carrier core materials include iron, steel, ferrite, magnetite, nickel and mixtures thereof. However, it is preferred that the carrier core material comprise low density, porous, magnetic or magnetically-attractable metal particles having a gritty, oxidized surface and a high surface area, i.e. a surface area which is at least about 200 $cm^2$/gram and up to about 1300 $cm^2$/gram of carrier material. For ultimate use in an electrostatographic magnetic brush development system, it is preferred that the carrier core materials have an average particle size of between about 30 microns and about 250 microns. Excellent results have been obtained when the carrier core materials comprise porous, sponge iron or steel grit. The carrier core materials are generally produced by gas or water atomization processes or by reduction of suitable sized ore to yield sponge powder particles. The powders produced have a gritty surface, are porous, and have high surface areas. By comparison, conventional carrier core materials usually have a high density and smooth surface characteristics.

When the treated carrier particles of this invention contain a coating material, any suitable thermoplastic or thermosetting insulating resinous material may be employed with the surface active additive. Typical insulating coating materials include vinyl chloride-vinyl acetate copolymers, styrene-acrylate-organosilicon terpolymers, natural resins such as caoutchouc, carnauba, colophony, copal, dammar, jalap, storax; thermoplastic resins including the polyolefins such as chlorinated polyethylene, chlorosulfonated polyethylene, and copolymers and mixtures thereof; polyvinyls and polyvinylidenes such as polymethyl-styrene, polymethyl methacrylate, polyacrylonitrile, polyvinyl acetate, polyvinyl alcohol, polyvinyl butyral, polyvinyl chloride, polyvinyl pyridine, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, thermosetting resins including phenolic resins such as phenol-formaldehyde, phenol-furfural and resorcinol formaldehyde; amino resins such as urea-formaldehyde and melmaine-formaldehyde; polyester resins, and the like, including copolymers, terpolymers, and mixtures thereof. Many of the foregoing and other typical carrier coating materials are described by L. E. Walkup in U.S. Pat. No. 2,618,551; B. B. Jacknow et al in U.S. Pat. No. 3,526,433; and R. J. Hagenbach et al in U.S. Pat. Nos. 3,533,835 and 3,658,500.

Any suitable finely-divided toner particles may be employed with the treated carrier particles of this invention. Typical toner particles contain, for example, gum copal, gum sandarac, rosin, asphaltum, phenol-formaldehyde resins, rosin-modified phenol-formaldehyde resins, methacrylate resins, polystyrene resins, polystyrene-butadiene resins, polester resins, polyethylene resins, epoxy resins and copolymers and mixtures thereof. However, toner resins containing a relatively high percentage of a styrene resin are preferred. The presence of a styrene resin is preferred because a greater degree of image definition is achieved. Further, denser images are obtained when at least about 25 percent by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Generally, suitable resins employed in the toner have a weight average molecular weight between about 3,000 to about 300,000. Patents describing typical electroscopic toner compositions include U.S. Pat. Nos. 2,659,670; 3,079,342; Reissue 25,136 and 2,788,288. Generally the toner materials have an average particle diameter of between about 5 and 15 microns. Generally speaking, satisfactory results are obtained when about 1 part by weight toner is used with about 10 to 200 parts by weight of the treated carrier particles of this invention.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, iron oxide, Rose Bengal and mixtures thereof. The pigment and/or dye should be present in the toner in a quality sufficient to render it highlv colored so that it will form a clearly visible image on a recording member. Thus, for example, where conventional xerographic copies of typed documents are desired, the toner may comprise a black pigment such as carbon black or a black dye such as Amaplast Black dye, available from National Aniline Products, Inc. Preferably, the pigment is employed in an amount from about 3 perecent to about 20 percent by weight, based on the total weight of the colored toner. If the toner colorant employed is a dye, substantially smaller quantities of colorant may be used.

The developer compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or ingorganic photoconductors embedded in a photoconductive matrix, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

In the following examples, the relative triboelectric values generated by contact of carrier particles with toner particles is measured by means of a Faraday Cage. The device comprises a steel cylinder having a diameter of about one inch and a length of about one inch. A 100-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the steel cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions.

DESCRIPTION OF PREFERRED EMBODIMENTS

The following examples further define, describe and compare methods of preparing the treated carrier materials of the present invention and of utilizing them to develop electrostatic latent images. Parts and percentages are by weight unless otherwise indicated.

EXAMPLE I

A control developer mixture was prepared as follows. A toner composition was prepared comprising about 10 percent furnace carbon black commercially available from Columbian Carbon Company of New York, New York, and about 90 percent of styrene-n-butyl methacrylate 58/42 copolymer resin by melt-blending the ingredients followed by mechanical attrition to yield toner particles having an average diameter of about 13 microns.

The carrier particles comprised steel beads having an average diameter of about 100 microns which had been washed with methyl alcohol and dried. About 1 part by weight of the toner composition was mixed with about 100 parts by weight of the carrier particles to form the developer mixture.

The resultant developer mixture was mixed for about 60 minutes after which time it was evaluated for triboelectric charging response pursuant to the aforementioned method. It was found that the carrier particles obtained a triboelectric charge of about 10.1 microcoulombs per gram of toner.

EXAMPLE II

A developer mixture was prepared as in Example I except that about 0.13 part by weight, based on the weight of the carrier particles, of a surface active additive consisting of Zonyl FSA (an anionic fluorinated surfactant), available from E. I. Du Pont Co., was coated on the carrier particles. The surface active additive was applied to the carrier particles by dissolving it in methyl alcohol and then evaporating the alcohol. About 1 part by weight of the toner composition of Example I was added to about 100 parts by weight of the treated carrier particles.

The resultant developer mixture was mixed for about 60 minutes after which time it was evaluated for triboelectric charging response as in Example I. It was found that the carrier particles obtained a triboelectric charge of about −8.5 microcoulombs per gram of toner.

EXAMPLE III

A developer mixture was prepared as in Example I except that about 0.20 part by weight, based on the weight of the carrier particles, of a surface active additive consisting of Zonyl FSB (an amphoteric fluorinated surfactant), available from E. I. duPont Co., was coated on the carrier particles. The surface active additive was applied to the carrier particles by dissolving it in methyl alcohol and then evaporating the alcohol. About 1.6 parts by weight of toner composition of Example I was added to about 100 parts by weight of the treated carrier particles.

The resultant developer mixture was mixed for about 60 minutes after which time it was evaluated for triboelectric charging response as in Example I. It was found that the carrier particles obtained a triboelectric charge of about −4.1 microcoulombs per gram of toner.

EXAMPLE IV

A developer mixture was prepared as in Example I except that about 0.25 part by weight, based on the weight of the carrier particles, of a surface active additive consisting of Fluorad FC-134 (a cationic fluorinaed surfactant), available from 3M Co., was coated on the carrier particles. The surface active additive was applied to the carrier particles by dissolving it in methyl alcohol and then evaporating the alcohol. About 0.7 part by weight of the toner composition of Example I was added to about 100 parts by weight of the treated carrier particles.

The resultant developer mixture was mixed for about 60 minutes after which time it was evaluated for triboelectric charging response as in Example I. It was found that the carrier particles obtained a triboelectric charge of about −4.2 microcoulombs per gram of toner.

EXAMPLE V

A control developer mixture was prepared as follows. A toner composition was prepared comprising about 10 percent furnace carbon black commercially available from Columbian Carbon Company of New York, N.Y. and about 90 percent of styrene-n-butyl methacrylate 58/42 copolymer resin by melt-blending the ingredients followed by mechanical attrition to yield toner particles having an average diameter of about 13 microns.

The carrier particles comprised steel beads having an average diameter of about 100 microns which had been washed with methyl alcohol and dried. To the steel beads was applied a resinous coating material comprising a polyvinyl chloride-trifluorochloroethylene copolymer commercially available as FPC-461 from Firestone Plastics Company, Pottstown, Pa. The coating material was dissolved in methyl ethyl ketone and applied to the steel beads as to provide them with a coating weight of about one percent by weight based on the weight of the beads. The coating composition was applied to the steel beads via solution coating employing a spray-dryer. About 1 part by weight of the toner composition was mixed with about 100 parts by weight of the carrier particles to form the developer mixture.

The resultant developer mixture was mixed for about 60 minutes after which time it was evaluated for triboelectric charging response pursuant to the aforementioned method. It was found that the carrier particles obtained a triboelectric charge of about −20 microcoulombs per gram of toner. When employed in an electrostatographic magnetic brush development system copying fixture, it was found that the developer mixture had a breakdown voltage of over 1,000 volts.

EXAMPLE VI

A developer mixture was prepared as in Example V except that about 6 percent by weight, based on the weight of the resinous coating material, of carbon black was dispersed in the coating material prior to its application to the carrier steel beads. About 1 part by weight of the toner composition of Example V was added to about 100 parts by weight of the resultant carrier particles.

The resultant developer mixture was mixed for about 60 minutes after which time it was evaluated for triboelectric charging response as in Example I. It was found that the carrier particles obtained a triboelectric charge of only about −5 microcoulombs per gram of toner.

When employed in an electrostatographic magnetic brush development system copying fixture as in Example V, it was found that the developer mixture had a breakdown voltage of about 300 volts.

EXAMPLE VII

A developer mixture was prepared as in Example VI except that about 0.25 percent by weight, based on the weight of the resinous coating material, of a surface active additive consisting of Zonyl FSA (an anionic fluorinated surfactant) available from E. I. duPont Co. was added to the carrier coating composition of Example VI. About 1 part by weight of the toner composition of Example V was added to about 100 parts by weight of the resultant carrier particles.

The resultant developer mixture was mixed for about 60 minutes after which time it was evaluated for triboelectric charging response as in Example I. It was found that the carrier particles obtained a triboelectric charge of about −15 microcoulombs per gram of toner. When employed in an electrostatographic magnetic brush development system copying fixture as in Example V, it was found that the developer mixture had a breakdown voltage of about 300 volts.

Although specific materials and conditions are set forth in the foregoing examples, these are merely intended as illustrations of the present invention. Various other suitable thermoplastic toner resin components, additives, colorants, and development processes such as those listed above may be substituted for those in the examples with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What we claimed is:

1. An electrostatographic developer mixture comprising finely-divided, positively triboelectrically charging toner particles electrostatically clinging to the surface of negatively triboelectrically charging carrier particles having an average diameter of from between about 30 microns and about 1,000 microns, said toner particles comprising a thermoplastic resin and a colorant, and said carrier particles comprising a core particle treated with from between about 0.001 percent and about 1.0 percent by weight, based on the weight of said carrier particles, of at least one surface active additive selected from highly fluorinated surfactants having an ionic group, said ionic group being selected from a cationic, anionic, nonionic, and amphoteric group.

2. An electrostatographic developer mixture in accordance with claim 1 wherein said fluorinated surfactants comprise anionic surfactants.

3. An electrostatographic developer mixture in accordance with claim 1 wherein said fluorinated surfactants comprise cationic surfactants.

4. An electrostatographic developer mixture in accordance with claim 1 wherein said surface active additive is present in an amount of from about 0.01 percent to about 0.5 percent by weight based on the weight of said carrier particles.

5. An electrostatographic developer mixture in accordance with claim 1 wherein said core particle comprises a metal.

6. An electrostatographic developer mixture in accordance with claim 5 wherein said metal is selected from the group consisting of iron, steel, ferrite, magnetite, nickel, and mixtures thereof.

7. An electrostatographic developer mixture in accordance with claim 1 wherein said core particle comprises low density, porous, magnetic or magnetically attractable metal particles having a gritty, oxidized surface area of at least about 200 $cm^2$/gram and up to about 1300 $cm^2$/gram.

8. An electrostatographic developer mixture in accordance with claim 1 wherein said toner particles contain at least about 25 percent by weight, based on the total weight of resin in said toner particles, of a styrene resin.

9. An electrostatographic developer mixture in accordance with claim 1 wherein said toner particles are present in an amount of about 1 part by weight per about 10 to 200 parts by weight of said carrier particles.

10. An electrostatographic developer mixture comprising finely-divided toner particles electrostatically clinging to the surface of carrier particles having an average diameter of from between about 30 microns and about 1,000 microns, said toner particles comprising a thermoplastic resin and a colorant, and said carrier particles comprising a core particle treated with from between about 0.001 percent and about 1.0 percent by weight, based on the weight of said carrier particles, of at least one surface active additive selected from highly fluorinated surfactants having an ionic group, said ionic group being selected from a cationic, anionic, nonionic, and amphoteric group, said surface active additive being capable of providing a negative triboelectric charging potential to said carrier particles.

* * * * *